US009772593B2

(12) United States Patent
Tatematsu

(10) Patent No.: US 9,772,593 B2
(45) Date of Patent: Sep. 26, 2017

(54) SHEET CONVEYER AND IMAGE FORMING APPARATUS

(71) Applicant: Brother Kogyo Kabushiki Kaisha, Nagoya-shi, Aichi-ken (JP)

(72) Inventor: Hirotaka Tatematsu, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/087,166

(22) Filed: Mar. 31, 2016

(65) Prior Publication Data

US 2017/0090382 A1 Mar. 30, 2017

(30) Foreign Application Priority Data

Sep. 30, 2015 (JP) ..... 2015-193644

(51) Int. Cl.

| | |
|---|---|
| ***B65H 1/08*** | (2006.01) |
| ***G03G 15/00*** | (2006.01) |
| ***B65H 1/04*** | (2006.01) |
| ***B65H 1/14*** | (2006.01) |
| ***B65H 3/06*** | (2006.01) |
| ***B65H 9/08*** | (2006.01) |

(52) U.S. Cl.

CPC ..... *G03G 15/6529* (2013.01); *B65H 1/04* (2013.01); *B65H 1/14* (2013.01); *B65H 3/06* (2013.01); *B65H 9/08* (2013.01); *G03G 15/6511* (2013.01); *B65H 2301/36212* (2013.01); *B65H 2405/114* (2013.01); *B65H 2405/11425* (2013.01)

(58) Field of Classification Search

CPC ..... B65H 2301/36212; B65H 2405/11425; B65H 2405/1144; B65H 9/08

See application file for complete search history.

(56) References Cited

U.S. PATENT DOCUMENTS

| | | | | |
|---|---|---|---|---|
| 7,429,041 | B2 * | 9/2008 | Yokoi | B65H 1/04 271/145 |
| 7,618,038 | B2 * | 11/2009 | Aida | B65H 1/04 271/145 |
| 8,141,868 | B1 * | 3/2012 | Wang | B65H 1/04 271/171 |
| 2014/0016980 | A1 | 1/2014 | Minoshima | |
| 2014/0210157 | A1 * | 7/2014 | Aoyama | B65H 1/04 271/147 |

FOREIGN PATENT DOCUMENTS

JP 2014-015315 A 1/2014

* cited by examiner

*Primary Examiner* — Howard Sanders
(74) *Attorney, Agent, or Firm* — Banner & Witcoff, Ltd.

(57) ABSTRACT

A sheet conveyer, having a sheet supporting plate, a feed roller, a lifting device to move the sheet supporting plate between a separated position and a contacting position, a motor, a sheet guide disposed on the sheet supporting plate to extend orthogonally to an axial direction of a rotation shaft of the feed roller to be movable in the axial direction on the sheet supporting plate, and a contact member disposed in an upper position with respect to the sheet guide, is provided. The sheet guide includes a retractable member movable between a first position, in which the retractable member is located when the sheet supporting plate is in the separated position, and a second position, in which the retractable member is placed by a reaction force from the contact member produced by contact between the sheet supporting plate and the feed roller.

6 Claims, 11 Drawing Sheets

SHEET CONVEYER AND IMAGE FORMING APPARATUS

CROSS REFERENCE TO RELATED APPLICATION

This application claims priority from Japanese Patent Application No. 2015-193644, filed on Sep. 30, 2015, the entire subject matter of which is incorporated herein by reference.

BACKGROUND

Technical Field

An aspect of the present invention relates to a sheet guide for stabilizing a position of a sheet placed on a lifting plate.

Related Art

An image forming apparatus, such as a printer, having a sheet conveyer to convey a sheet to form an image thereon is known. The sheet conveyer may include a lifting plate, on which one or more sheets may be stacked. The lifting plate may pivot about a pivot shaft, which may be arranged on an upstream end thereof with regard to a sheet-conveying direction, to lift a downstream end thereof upward. In a position above the lifting plate, there may be a feed roller, which may feed the sheets to an image forming unit. The downstream end of the lifting plate may move between a separated position, in which the downstream end is lowered and separated from the feed roller, and an approximate position, in which the downstream end is uplifted to be closer to the feed roller.

The sheet conveyer may further have a pair of side guides, which may restrict the sheets stacked on the lifting plate from moving. The side guides may slidably move on the lifting plate so that, while a position of the sheets on the lifting plate may vary depending on a size thereof, the sheets may be flanked by the side guides at widthwise ends to be interposed between the side guides.

SUMMARY

The forementioned side guides may be movable in conjunction with the lifting plate, which is movable between the separated position and the approximate position. Therefore, the side guides being uplifted along with the lifting plate may interfere or collide with neighboring parts or items, including the feed roller.

In view of such a concern, the present disclosure is advantageous in providing a sheet conveyer and an image forming apparatus, in which sheet guides being uplifted along with a lifting plate may be restrained from interfering with neighboring items.

According to an aspect of the present disclosure, a sheet conveyer, including a sheet supporting plate; a feed roller disposed in an upper position with respect to the sheet supporting plate, the feed roller including a rotation shaft extending in parallel with the sheet supporting plate; a lifting device configured to move the sheet supporting plate between a separated position, in which the sheet supporting plate is separated from the feed roller, and a contacting position, in which the sheet supporting plate is lifted from the separated position to contact the feed roller; a motor configured to drive the lifting device; a sheet guide disposed on an upper surface of the sheet supporting plate to extend in a direction orthogonal to an axial direction of the rotation shaft of the feed roller, the sheet guide being movable in the axial direction on the upper surface of the sheet supporting plate; and a contact member disposed in an upper position with respect to the sheet guide, is provided. The sheet guide includes a retractable member, the retractable member being movable between a first position, in which the retractable member is located when the sheet supporting plate is in the separated position, and a second position, in which the retractable member is located by an effect of a reaction force from the contact member produced by contact between the sheet supporting plate and the feed roller when the sheet supporting plate is in the contacting position to contact the feed roller.

According to another aspect of the present disclosure, an image forming apparatus having a sheet conveyer and an image forming unit is provided. The sheet conveyer includes a sheet supporting plate; a feed roller disposed in an upper position with respect to the sheet supporting plate, the feed roller including a rotation shaft extending in parallel with the sheet supporting plate; a lifting device configured to move the sheet supporting plate between a separated position, in which the sheet supporting plate is separated from the feed roller, and a contacting position, in which the sheet supporting plate is lifted from the separated position to contact the feed roller; a motor configured to drive the lifting device; a sheet guide disposed on an upper surface of the sheet supporting plate to extend in a direction orthogonal to an axial direction of the rotation shaft of the feed roller, the sheet guide being movable in the axial direction on the upper surface of the sheet supporting plate; and a contact member disposed in an upper position with respect to the sheet guide. The image forming unit is configured to form an image on a sheet fed by the feed roller. The sheet guide includes a retractable member, the retractable member being movable between a first position, in which the retractable member is located when the sheet supporting plate is in the separated position, and a second position, in which the retractable member is located by an effect of a reaction force from the contact member produced by contact between the sheet supporting plate and the feed roller when the sheet supporting plate is in the contacting position to contact the feed roller.

BRIEF DESCRIPTION OF THE ACCOMPANYING DRAWINGS

FIG. 1 a front view of a monochrome laser printer according to a first embodiment of the present disclosure.

DETAILED DESCRIPTION

Hereinafter, exemplary embodiments of laser printers 10, 160 according to the present disclosure will be described with reference to the accompanying drawings.

First Embodiment

Figure 1:
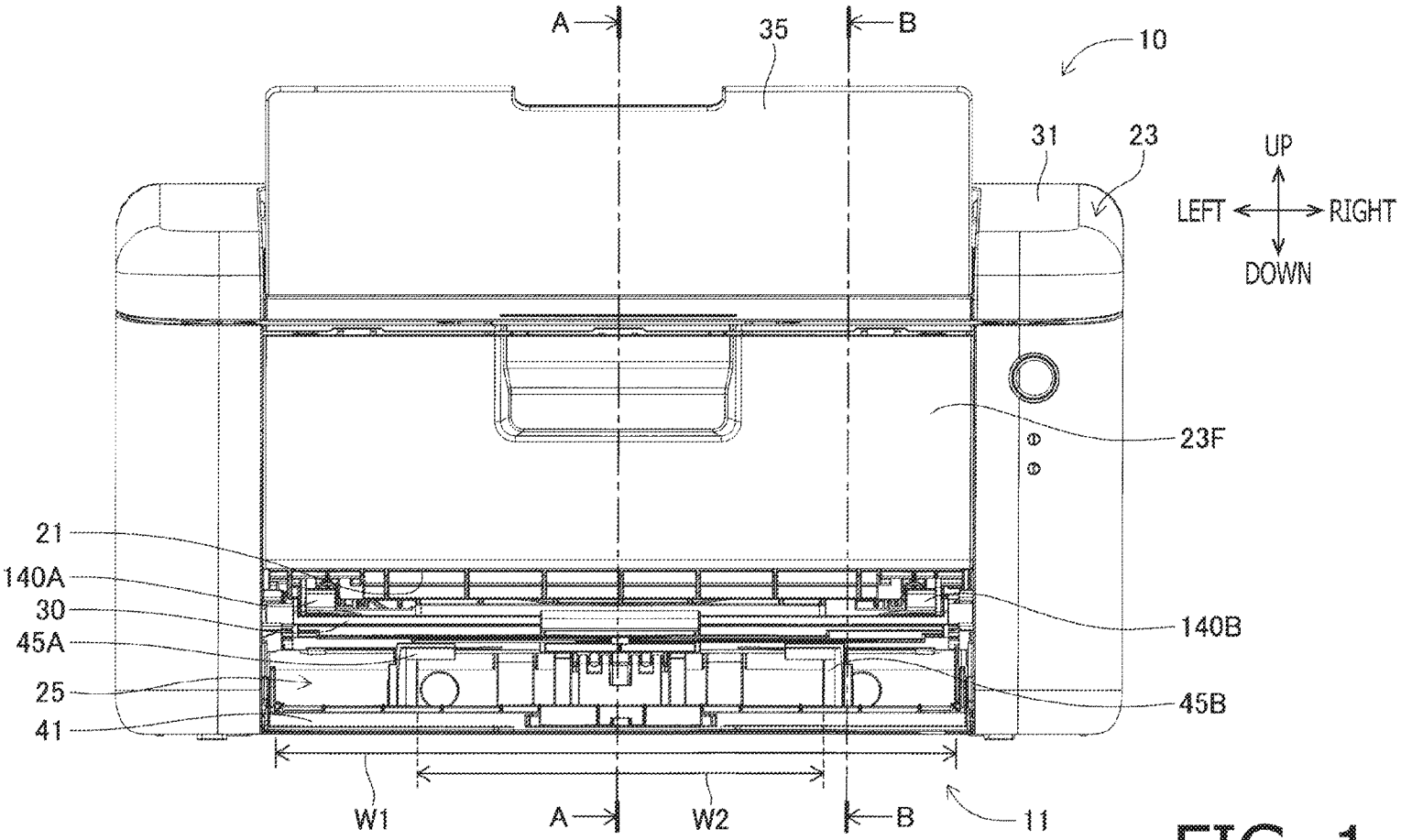
Figure 2:
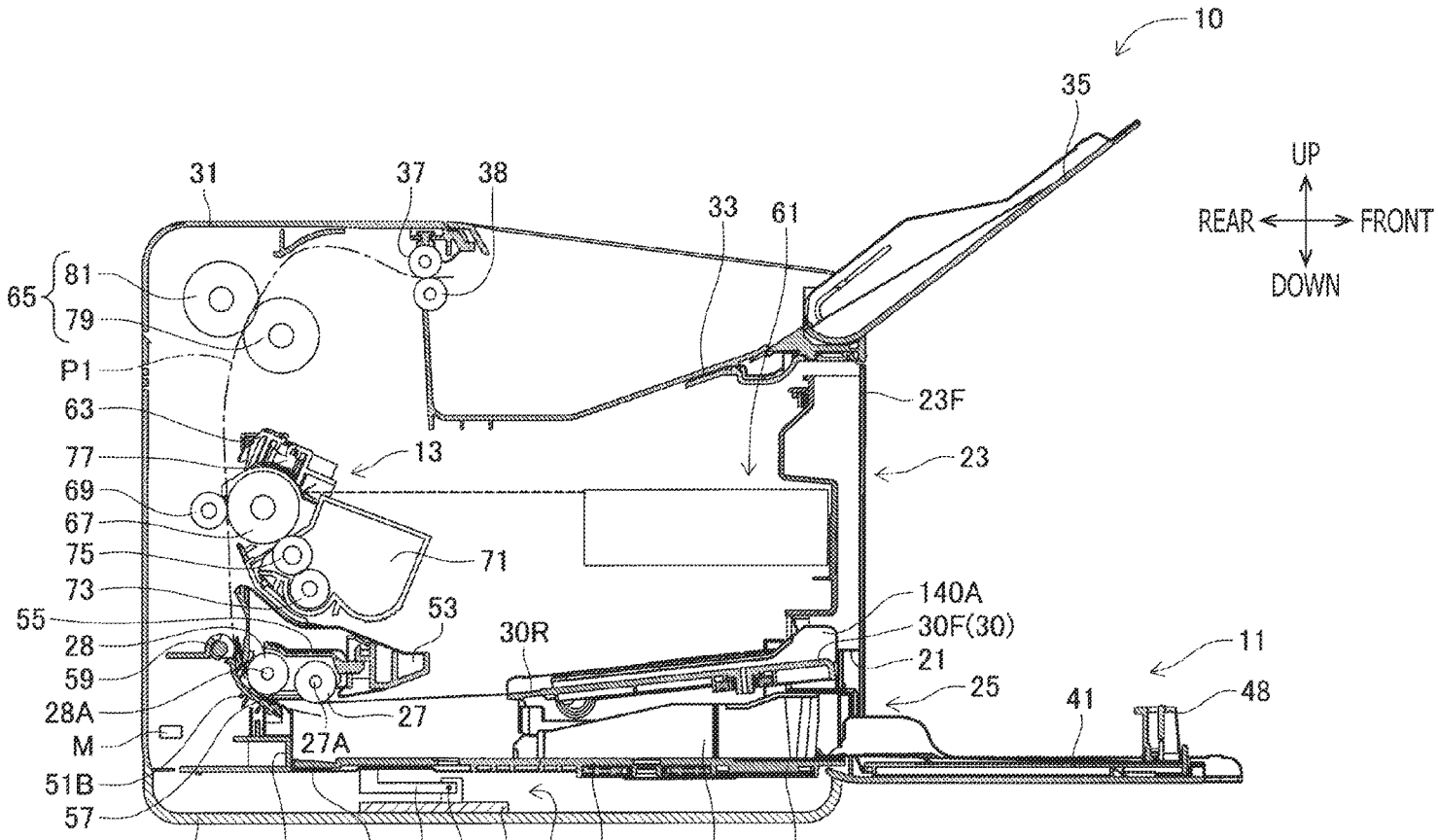
FIG. 2 is a cross-sectional rightward view of the laser printer, at a line A-A shown in FIG. 1, according to the first embodiment of the present disclosure, with a lifting plate lowered to a separated position.
Figure 3:
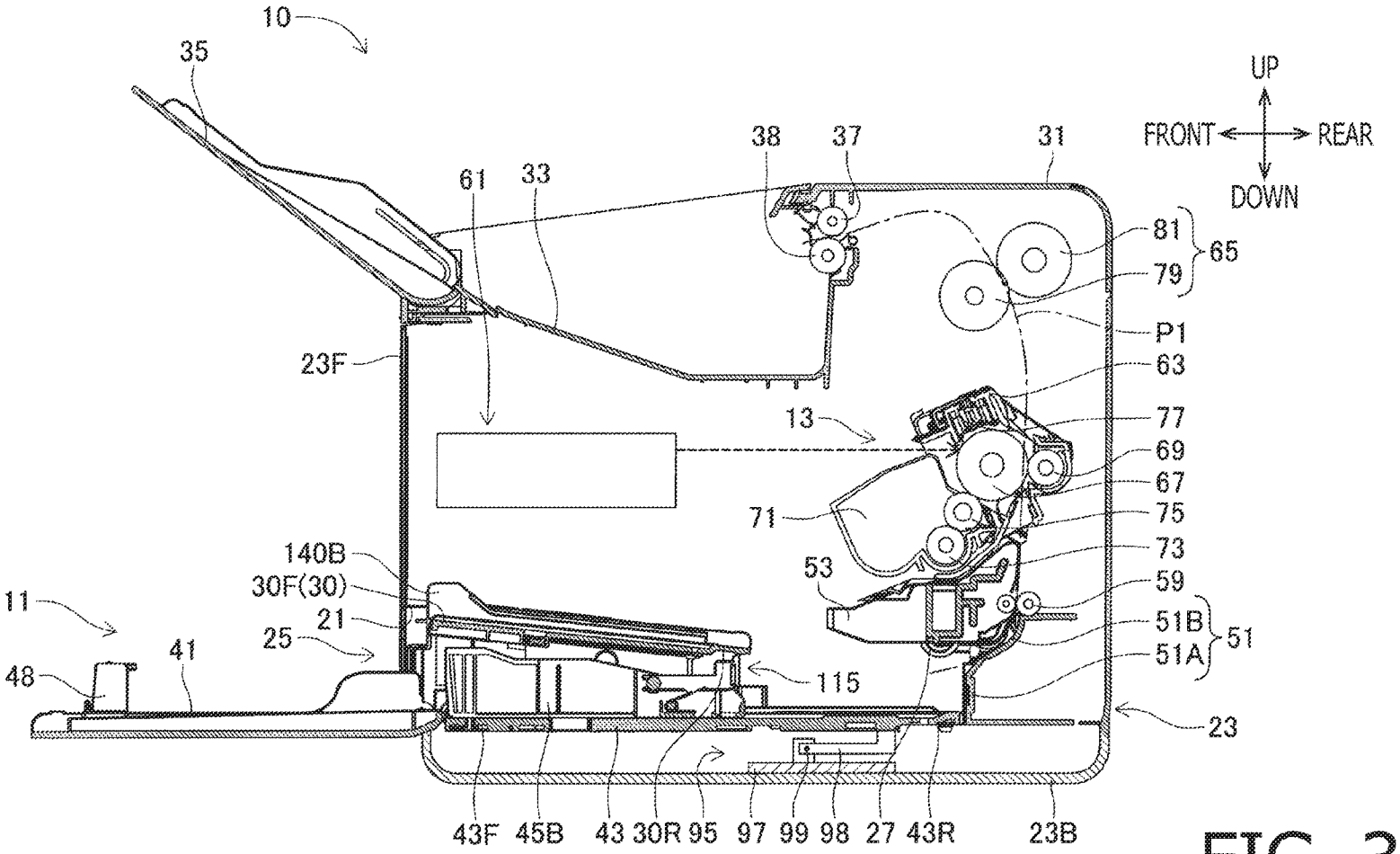
FIG. 3 is a cross-sectional leftward view of the laser printer, at a line B-B shown in FIG. 1, according to the first embodiment of the present disclosure, with the lifting plate lowered to the separated position.

The laser printer 10 according to a first embodiment may be a monochrome laser printer and will herein after be referred to as a printer 10. As shown in FIGS. 1-3, the printer 10 includes a sheet conveyer 11 and an image forming unit 13. In the following description, a side appearing in FIG. 1, on which an opening 21 is formed, is referred to as a front side of the printer 10. Then, directions concerning the printer 10 will be referred to based on a user's position to ordinarily use the printer 10 and in accordance with orientation indicated by arrows shown in FIG. 1. That is, for example, the user's, or a viewer's, left-hand side, when the user faces the front side with the opening 21 of the printer 10, is referred to as a left-side side of the printer 10. Further, a front-to-rear or rear-to-front direction (depth), a right-to-left or left-to-right (widthwise) direction, and an up-to-down or down-to-up (vertical) direction are defined based on the user's view point. The orientation of the printer 10 is also indicated by arrows shown in each drawing. In FIGS. 1-3, shown is a separated position of a lifting plate 43, in which the lifting plate 43 is laid horizontally along the front-rear direction and the widthwise direction without activating a lifting device 95.

<Overall Configuration of the Printer>

As shown in FIG. 3, the printer 10 includes a body 23, a first placement unit 25, a feed roller 27, a separator roller 28, and a second placement unit 30. The body 23 includes a chassis having a shape of a tiered box, which is higher on the rear side and lower on the front side, An upper part of the body 23 is covered with by a main cover 31, which forms an upper outer face of the body 23. The main cover 31 is formed to have a cross-sectional shape of a crank, in a view from a lateral position, along the tiered shape of the body 23.

The main cover 23 is formed to have an ejection tray 33 on a frontward part thereof. Further, an auxiliary tray 35 is arranged on a front end of the ejection tray 33. The auxiliary tray 35 includes a flat plate and is supported by the front end of the ejection tray 33 to be pivotable. The auxiliary tray 35 is movable between an extended position, in which the auxiliary tray 35 is extended to align with the ejection tray 33, and a covering position, in which the auxiliary tray 35 covers the ejection tray 33 from above. In FIGS. 1-3, shown is the auxiliary tray 35 in the extended position. In a position above a rear end of the ejection tray 33, disposed are ejection rollers 37, 38.

The first placement unit 25 is disposed in a bottom part of the body 23 and is capable of accommodating sheets, e.g., sheets of paper, OHP films, etc., which are not shown. The first placement unit 25 includes an openable/closable tray 41 and the lifting plate 43. The openable/closable tray 41 includes a piece of plate, which is pivotable about a lower end of a front face 23F of the body 23. In a lower position on the front face 23F of the body 23, formed is the opening 21, through which space inside the body 23 and external atmosphere communicates with each other. When the openable/closable tray 41 is in an open position to lie frontward and horizontally, the opening 21 is exposed, as shown in FIGS. 1-3. When the openable/closable tray 41 is in a closed position not shown) to stand vertically, the opening 21 is covered.

The lifting plate 43 includes a piece of plate extending from a front end of the body 23 rearward at a bottom part of the body 23. The lifting plate 43 may be made of resin. On an upper surface of the lifting plate 43 and on an upward-facing surface of the openable/closable 41, which faces upward when the openable/closable tray 41 is in the open position, one or more sheets to be conveyed may be placed. On the lifting plate 43, arranged are first lateral guides 45A, 45B, which will be described in detail later.

Inside the body 23, arranged are a conveyer chute 51, a supporting frame 53, and other frame components which are not shown. The frame components, including the conveyer chute 51, may be made of resin. The conveyer chute 51 is disposed in a lower-rearward position in the body 23 to spread in the vertical and widthwise directions. Widthwise ends of the conveyer chute 51 are supported by lateral frames, which are not shown. The conveyer chute 51 is formed to have a vertical plane 51A, which rises vertically from a bottom 23B of the body 23, and an inclined plane 51B, which inclines upper-rearward from an upper end of the vertical plane 51A.

The body 23 includes a conveyer path P1, along which the sheets may be conveyed. The conveyer path P1 is formed to extend from an upper end of the vertical plane 51A of the conveyer chute 51 upper-rearward along the inclined plane 51B and curved upward to extend vertically. Further, the conveyer path P1 turns frontward at a position below the main cover 31 to reach the ejection rollers 37, 38 and ends at the ejection tray 33.

The supporting frame 53 is disposed in an upper-frontward position with respect to the inclined plane 51B of the conveyer chute 51. The supporting frame 53 is formed to spread in the widthwise direction, and widthwise ends thereof are supported by the lateral frames, which are not shown. The supporting frame 53 is formed to have a housing 55, in a widthwise central area thereof, to accommodate the feed roller 27 and the separator roller 28. Thus, the feed roller 27 and the separator roller 28 are disposed in vicinity of a most upstream position in the conveyer path P1 with regard to a sheet-conveying direction to covey the sheets in the conveyer path P1.

The separator roller 28 is arranged in an upper position with respect to inclined plane 51B of the conveyer chute 51 and is rotatable about a roller shaft 28A, which extends in parallel with the widthwise direction. The feed roller 27 is arranged in a frontward position petit to the conveyer chute 51 and the separator roller 28 and in an upper position with respect to a rear-end part 43R of the lifting plate 43. The feed roller 27 is rotatable about a roller shaft 27A, which extends in parallel with the widthwise direction. The roller shaft 27A of the feed roller 27 is engaged with the roller shaft 28A of the separator roller 28 through gears, which are not shown, so that the feed roller 27 and the separator roller 28 are driven to rotate synchronously. The roller shafts 27A, 28A of the feed roller 27 and the separator roller 28 are rotatably supported by the supporting frame 53. The feed roller 27 and the separator roller 28 may be driven by a driving force from a motor M (see FIG. 2), which is disposed in the body 23, to feed the sheets placed on the first placement unit 25 or the second placement unit 30 to the conveyer path P1. The inclined plane 51B of the conveyer chute 51 may contact the sheets conveyed by the separator roller 28 and the feed roller 27 from below and guide the sheets along the conveyer path P1.

A separator pad 57 is disposed on e inclined plane 51B of the conveyer chute 51 in a position corresponding to the separator roller 28 across the conveyer path P1 to be urged against the separator roller 28. Thus, the separator roller 28 and the separator pad 57 separates the sheets from one another.

In a position above the separator roller 28, disposed is conveyer roller 59. The conveyer roller 59 is arranged to face with a mating roller (unsigned) to face each other along the front-rear direction across the conveyer path P1. The conveyer roller 59 and the mating roller are arranged to nip the sheet being conveyed there-between and rotate to convey the sheet separated by the separator roller 28 and the separator pad 57 toward a processing cartridge 63 in the image forming unit 13.

<Configuration of the Image Forming Unit>

The image forming unit 13 includes a scanner unit 61, a processing cartridge 63, and a fixing unit 65. The scanner unit 61 is disposed in a frontward position in the body 23, in an upper position with respect to the first placement unit 25 and the second placement unit 30. The scanner unit 61 may include a laser light source, a polygon mirror, an fθ lens, and reflection mirrors, which are not shown. The scanner unit 61 emits a laser beam toward a photosensitive drum 67 in the processing cartridge 63, which is arranged in a rearward position, so that a surface of the photosensitive drum 67 is exposed to the emitted laser beam, and an electrostatic latent image corresponding to image data is formed on the surface of the photosensitive drum 67.

The processing cartridge 63 is disposed in an upper position with respect to the supporting frame 53. The processing cartridge 63 may have a shape of a box elongated along the widthwise direction. The processing cartridge 63 includes the photosensitive drum 67, a transfer roller 69, a container 71, a supplier roller 73, a developer roller 75, and a charger 77. The photosensitive drum 67 may have a cylindrical body axially extending along the widthwise direction. The transfer roller 69 is arranged to face the photosensitive drum 67 in the front-rear direction across the conveyer path P1. The sheet conveyed by the conveyer roller 59 is further conveyed upward in the processing cartridge 63. The photosensitive drum 67 and the transfer roller 69 nip the sheet being conveyed upward in the conveyer path P1 and rotate synchronously.

The container 71 may contain toner to be supplied to the photosensitive drum 67. The supplier roller 73 supplies the toner from the container 71 to the developer roller 75. The developer roller 75 develops the electrostatic latent image formed on the surface of the photosensitive drum 67 to be a toner image. The toner image is transferred to the sheet when the sheet conveyed in the conveyer path P1 contacts the photosensitive drum 67 while negative voltage is applied to the transfer roller 69.

The charger 77 is disposed in an upper position with respect to the photosensitive drum 67 and longitudinally extends along the widthwise direction in parallel with the photosensitive drum 67. The charger 77 discharges corona to positively charge the photosensitive drum 67.

The fixing unit 65 is disposed in an upper position with respect to the photosensitive drum 67 and the transfer roller 69. The fixing unit 65 includes a heat roller 79 and a pressure roller 81 disposed in a rearward position with respect to the heat roller 79 across the conveyer path P1.

The sheet with the toner image transferred thereon is conveyed further upward along the conveyer path P1 to reach the fixing unit 65, where the heat roller 79 heats the sheet and the pressure roller 81 urges the sheet against the heat roller 79. Thus, the toner image is fixed on the sheet by the heat and the pressure. The sheet with the fixed image is conveyed by the ejection rollers 37, 38 and ejected to rest on the ejection tray 33.

<Configuration of the First Placement Unit>

Figure 4:
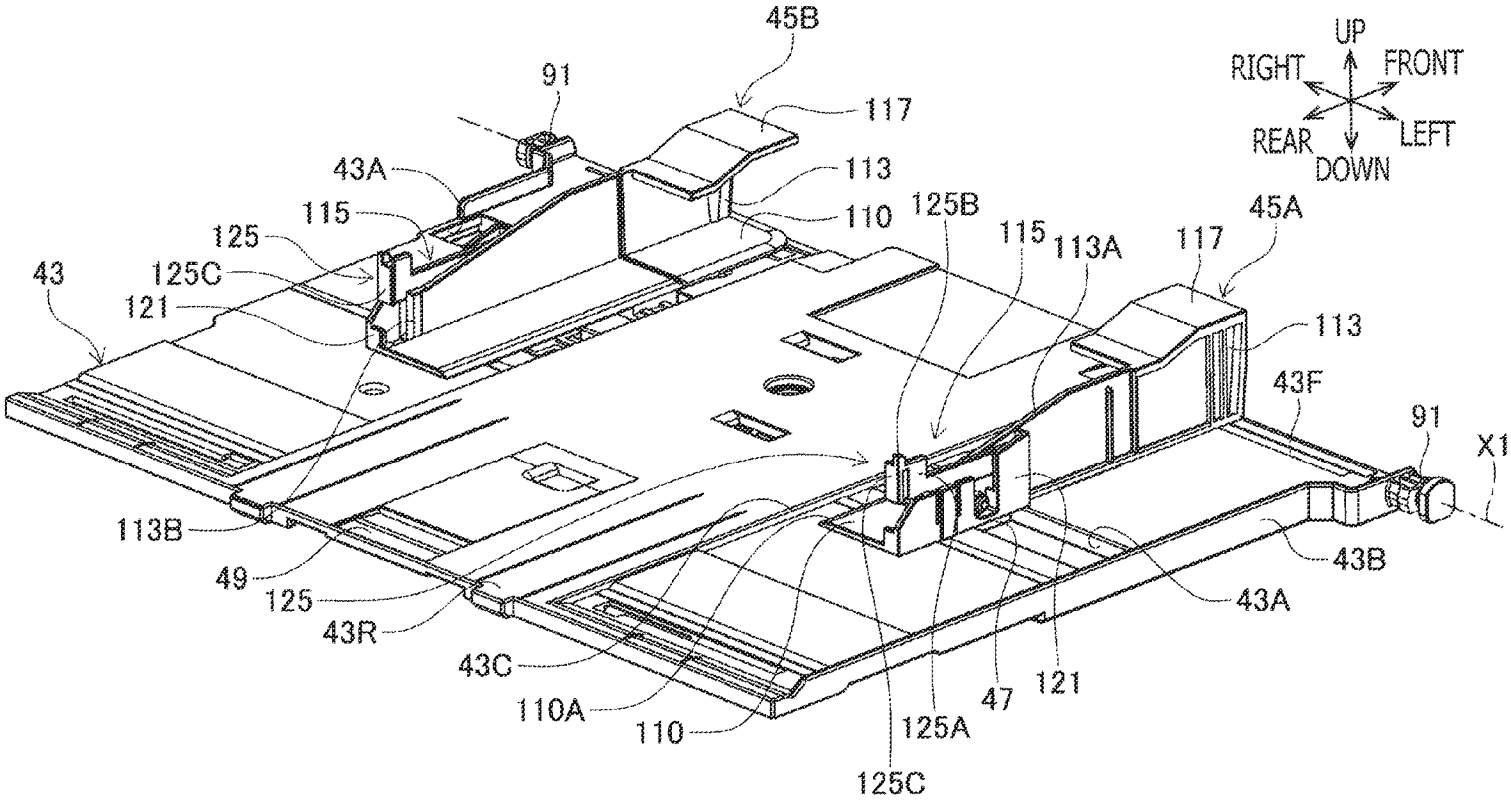
FIG. 4 is a perspective view of the lifting plate, in a view from an upper-rearward position, according to the first embodiment of the present disclosure.

As shown in FIGS. 3 and 4, the lifting plate 43 includes a frontend part 43F and shafts 91, which protrude outward in the widthwise direction from widthwise end of the frontend part 43F. Each of the shafts 91 is rotatably inserted in a bearing (not shown) formed in the body 23 so that the lifting plate 43 may be pivotably supported by the body 23. The frontend part 43F may be thus pivotable about a pivot axis X1 (see FIG. 4), which extends in parallel with the widthwise direction.

The lifting plate 43 includes the rear-end part 43R, which is arranged in a position proximity to the vertical plane 51A of the conveyer chute 51 to be spaced apart from the vertical plane 51A. As the lifting plate 43 pivots about the pivot axis X1, the rear-end part 43R of the lifting plate 43 moves upward or downward in a lower position with respect to the feed roller 27.

The lifting plate 43 includes a frictional piece 49, which arranged on the rear-end part 43R of the lifting plate 43, in a widthwise central area. The frictional piece 49 is a thin piece of frictional material with higher friction coefficient. The frictional piece 48 is arranged in a position to contact the feed roller 27, when the lifting plate 43 with no sheet stacked thereon is uplifted. Meanwhile, the frictional piece 79 may apply frictional force to a sheet when the sheet placed on the first placement unit 25 or on the second placement unit 30 is fed by the feed roller 27 so that multiple feed, in which a plurality of sheets are fed at a time, may be prevented. In other words, the lifting plate 43 may contact the feed roller 27 either directly or indirectly through the sheet.

In a lower position with respect to an approximate center of the lifting plate 43 in the widthwise direction, disposed is a lifting device 95. The lifting device 95 includes a fixed board 97 and a pivotable board 98. The fixed board 97 is fixed to the bottom 23B of the body 23. The pivotable board 98 may be a metal plate spreading in the widthwise direction and is pivotable about a pivot shaft 99, which is supported by the fixed board 97. Meanwhile, the driving force from the motor M (see FIG. 2) disposed in the body 23 may be transmitted to the pivotable board 98 through movable parts (not shown) such as gears and cams to pivot the pivotable board 98 upward. The pivotable board 98 may thus pivot and uplift the lifting plate 43 upward.

In an initial condition, when the lifting device 95 is not activated or pivoted upward, the lifting plate 43 is laid horizontally in a lower and separated apart position from the feed roller 27. When a printing operation starts, and an image is formed in the printer 10, the motor M is activated, and the pivotable board 98 in the lifting device 95 is moved to pivot to an inclined posture to be tilted higher on the rear side (see FIG. 5). Accordingly, the lifting plate 43 is uplifted by the pivotable board 98 to an inclined posture with the rear-end part 43R lifted higher. The sheets stacked on the lifting plate 43 are urged against the feed roller 27, and a topmost sheet of the sheets on the lifting plate 43 contacts the feed roller 27. In this regard, a movable amount for the lifting plate 43 to be uplifted may depend on an amount of the sheets stacked on the lifting plate 43. When the feed roller 27 contacting the topmost sheet is rotated, the topmost sheet is fed in the conveyer path P1. When the printing operation ends, the pivotable board 98 is pivoted to be lowered and returns to the horizontally-laid position separated from the feed roller 27 (see FIG. 3).

As shown in FIG. 4, the first lateral guides 45A, 45B are arranged on the lifting plate 43 in positions spaced apart from each other along the widthwise direction, each extending along the front-rear direction. The first lateral guide 45A on the left and the first lateral guide 45B on the right are in a line-symmetric structure with respect to a hypothetical line, which extends through a midpoint between the first lateral guides 45A, 45B in parallel with the front-rear direction. Therefore, in the following description, while the first lateral guide 45A on the left may be described in detail, description of the first lateral guide 45B on the right may be omitted.

The first lateral guide 45A is arranged to extend longitudinally rearward from a position above the frontend part 43F along the front-rear direction to a rearward position with respect to a center of the lifting plate 43 in the front-rear direction. The first lateral guide 45A includes a base 110, a wall 113, and a retractable device 115 which will be described later in detail.

The base 110 includes a rectangular plate elongated in the front-rear direction and is arranged along the upper surface of the lifting plate 43. On a lower surface of the lifting plate 43, disposed is a rack-and-pinion device 47 in a position corresponding to the bases 110 of the first lateral guides 45A, 45B. The first lateral guides 45A, 45B are coupled to each other at the bases 110 through the rack-and-pinion device 47. Meanwhile, the lifting plate 43 is formed to have a slit 43A, in which a coupling part coupling the first lateral guide 45A with the rack-and-pinion device 47 is inserted. The slit 43A is formed through the lifting plate 43 vertically and is elongated along the widthwise direction at a constant breadth in the front-rear direction.

The wall 113 is formed continuously from a leftward edge of the base 110 to erect upward. The wall 113 includes a plate spreading in the vertical direction to erect from the base 110. An upper edge of the wall 113 inclines to be higher at the front side and lower at the rear side. On an upper-frontward end of the wall 113, formed is an operation handle 117, which protrudes rightward. The base 110, the wall 113, and the operation handle 117 may be formed integrally in resin. The operation handle 117 includes a plate formed to bend in tiers, which are lower on the rear side and higher on the front side. The operation handle 117 in the first lateral guide 45A on the left and the operation handle 117 in the first lateral guide 45B on the right are formed to extend to be closer to each other in the widthwise direction from the upper edges of the walls 13.

A user may pinch the operation handle 117 of the first lateral guide 45A on the left and slidably move in in one way along the widthwise direction. The slidable movement of the first lateral guide 45A on the left is transmitted to the first lateral guide 45B on the right via the rack-and-pinion device 47 to move the first lateral guides 45A, 45B in directions opposite from each other to be farther from or closer to each other. Thereby, the user may slidably move the first lateral guides 45A, 45B to positions corresponding to a width of the sheets placed on the lifting plate 43. The sheets placed on the lifting plate 43 may thus flanked by the walls 113 of the first lateral guides 145A, 45B and restricted from moving in the widthwise direction. Further, as shown in FIG. 2, on the openable/closable tray 41, arranged is an end guide 48, which is slidable in the front-rear direction. By the slidably movable end guide 48, a position of frontward ends of sheets placed on the openable/closable tray 41 may be restricted.

The first lateral guides 45A, 45B in the present embodiment are movable within a difference between a first width W1 and a second width W2 (see FIG. 1). In other words, the first lateral guides 45A, 45B may restrict a widthwise position of the sheets within a range between the first width W1 and the second width W2. The first width W1 may be a maximum width which is allowable as the width of the sheets to be used in the printer 10 and may be, for example, a width (216 mm) of a letter size (216 mm*279 mm). When the first lateral guides 45A, 45B are in positions corresponding to the first width W1, the walls 113 of the first lateral guides 45A, 45B may be in positions to contact or in proximity to widthwise ends 43B (see FIG. 4) of the lifting plate 43. On the other hand, the second width W2 may be a minimum width which is allowable as the width of the sheets to be used in the printer 10 and may be, for example, a width (148 mm) of A5 size (148 mm*210 mm). When the first lateral guides 45A, 45B are in positions corresponding to the second width W2, widthwise inner edges 110A (see FIG. 4) of the bases 110 may be in proximity to or may contact an edge 43C, which is formed in a widthwise central area on the lifting plate 43.

<Configuration of the Second Placement Unit>

The second placement unit 30 is disposed in the body 23 in an upper position with respect to the first placement unit 25 and a lower position with respect to an upper edge of the opening 21. The second placement unit 30 may be used to manually feed sheets, separately from the sheets placed on the lilting plate 43 in the first placement unit 25. The second placement unit 30 includes a plate spreading in the front-rear direction and is installed in the body 23 in an inclined posture to be higher on the front side and lower on the rear side. A frontend portion 30F of the second placement unit 30 is closer to the front face 23F of the body 23, and a rear-end portion 30R of the second placement unit 30 farther from the front face 23F is in a position above the rear ends of the first lateral guides 45A, 45B on the lifting plate 43 in the first placement unit 25. A width of the second placement unit 30 is smaller than a width of the lifting plate 43 in the first placement unit 25.

The second placement unit 30 includes second lateral guides 140A, 140B, which are slidably movable in the widthwise direction. The second lateral guides 140A, 140B are arranged in positions spaced apart from each other along the widthwise direction to be elongated along the front-rear direction. The second lateral guide 140A on the left and the second lateral guide 140B on the right are, similarly to the first lateral guides 45A, 45B, coupled to each other through a rack-and-pinion device (not shown). Therefore, the second lateral guides 140A, 140B are movable in conjunction with each other in opposite directions to be farther from or closer to each other and restrict the sheets placed on the second placement unit 30 from moving in the widthwise direction.

Meanwhile, in the body 23, arranged are guide rails (not shown), through which the second placement unit 30 may be engaged with the body 23. The guide rails are arranged on widthwise inner sides of the body 23 in positions to install the second placement unit 30 to lie along the front-rear direction. The second placement unit 30 may be inserted through the opening 21 and engaged with the guide rails to be slidably moved rearward to be installed in the body 23.

When a sheet is manually fed in the printer 10 through the second placement unit 30, the user may insert the sheet through the opening 21 to supply the sheet to the second placement unit 30. The manually-supplied sheet may be guided to slide lower-rearward on the second placement unit 30. A rearward end, or a leading end, of the manually-supplied sheet may contact the lifting plate 43 or the topmost sheet of the sheets placed on the lifting plate 43, and the manually-supplied sheet may slide thereon rearward. The leading end of the manually-supplied sheet may then reach the vertical plane 51A of the conveyer chute 51 and stop thereat. Meanwhile, the printing operation may start, and the lifting device 95 may be activated. The leading end of the manually-supplied sheet on the second placement unit 30 is lifted upward by the lifting plate 43 to contact the feed roller 27. As the feed roller 27 is rotated, the manually-supplied sheet may be fed in the conveyer path P1.

<Configuration of the Retractable Device in the First Placement Unit>

The first lateral guides 45A, 45B are movable vertically integrally with the lifting plate 43 along with the vertical movement of the lifting plate 43. Meanwhile, it may be concerned that the walls 113 of the first lateral guides 45A, 45B may interfere with the second placement unit 30. In this regard, as shown in FIG. 4, the first lateral guides 45A, 45B each has the retractable device 115. The retractable device 115 in the first lateral guide 45B on the right is similar to the retractable device 115 in the first lateral guide 45A on the left; therefore, description of the retractable device 115 in the first lateral guide 45B on the right may be omitted.

Figure 6:
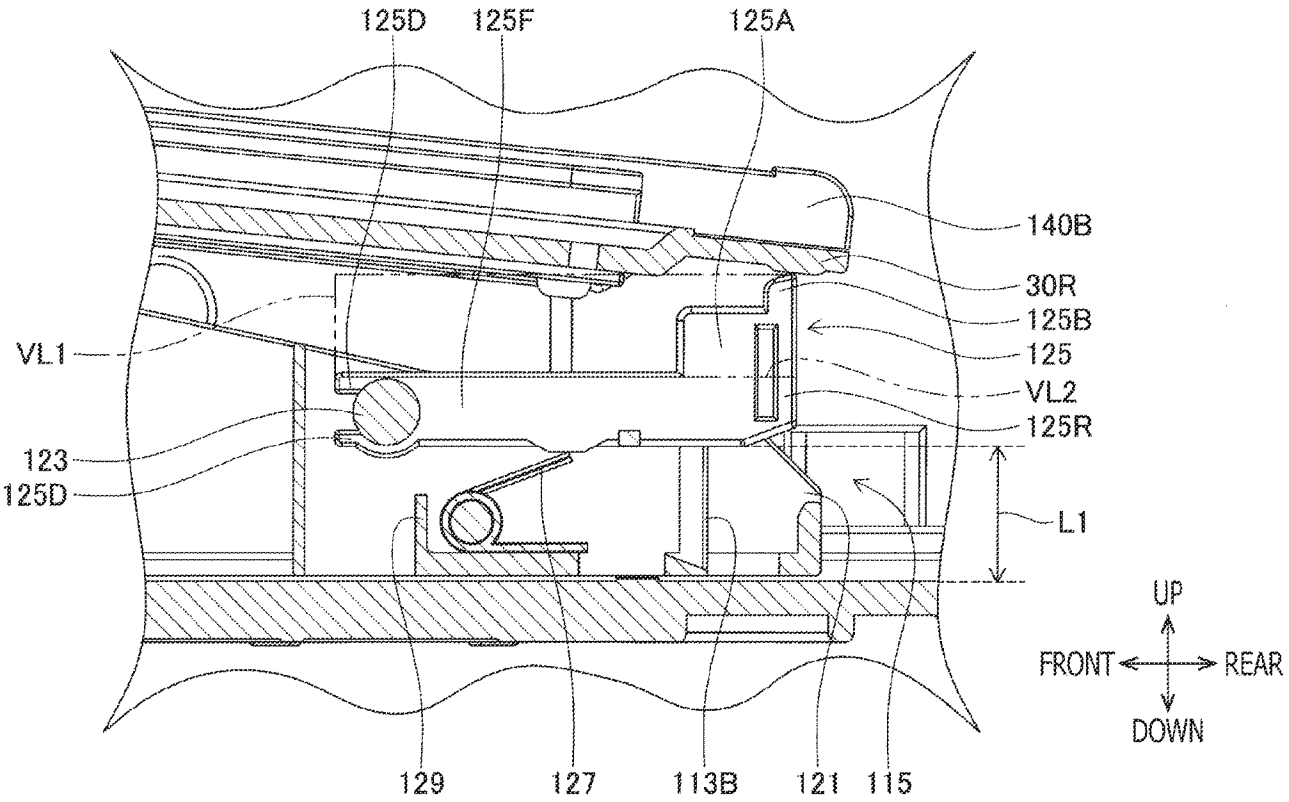
FIG. 6 is an enlarged view of a retractable member on the lifting plate in a first position according to the first embodiment of the present disclosure.

The retractable device 115 is disposed on a rear end part of the first lateral guide 45A on an outer side, or a leftward side, of the wall 113. As shown in FIGS. 4 and 6, the retractable device 115 includes a housing 121, a first pivot shaft 123, a retractable member 125, a spring 127, and a spring anchor 129. The housing 121 is formed to have an approximate shape of a top-open box, which may be shorter in the widthwise direction, longer in the front-rear direction, and shorter in the vertical direction.

Meanwhile, the wall 113 is formed to have an inclined edge 113A, in a range between an approximate center in the front-rear direction and the rear end of the wall 113. The inclined edge 113A inclines at a constant angle to be higher at a front side and lower at a rear side. The housing 121 is arranged on the outer side of the wall 113 in the range of the inclined edge 113A. The housing 121 may be integrally formed with the base 110 and the wall 113 in, for example, resin.

The first pivot shaft 123 is arranged in the housing 121 and includes a cylindrical rod extending in parallel with the widthwise direction. Longitudinal ends of the first pivot shaft 123 are fixed to walls inside the hosing 121 that face each other along the widthwise direction. The retractable member 125 includes a plate or a thin bar elongated in the front-rear direction. On a rear-end portion 125R of the retractable member 125, formed is a first projection 125A, which is in a same width as the rear-end portion 125R but projects upward to be higher than the rear-end portion 125R. Further, on an upper-rear end of the first projection 125A, formed is a second projection 125B, which projects upward from the first projection 125A.

Further, a bent portion 125C is formed on a rearward end of the first projection 125A and the second projection 125B (see FIG. 4). The bent portion 125C is formed to extend inward along the widthwise direction from a rear end of the retractable member 125, which is on the outer side of the wall 113. The bent portion 125C is stretched to a position, in which the bent portion 125C faces a rearward surface 113B of the wall 113 along the front-rear direction. The bent portion 125C is arranged in a rearward and spaced apart position from the rearward surface 113B of the wall 113.

In a frontend portion 125F of the retractable member 125, formed is a bifurcated part 125D, which is divided vertically in two segments. The bifurcated part 125D is arranged to protrude frontward from the frontend portion 125F in parallel with the front-rear direction. The retractable member 125 is arranged to be pivotable in the vertical direction about the first pivot shaft 123, with the first pivot shaft 123 interposed between the two segments in the bifurcated part 125D. The first lateral guide 45A having the first pivot shaft 123 and the housing 121 may be formed integrally in resin. Meanwhile, the retractable member 125 may be formed separately from the first lateral guide 45A. The separately formed retractable member 125 may be inserted in the housing 121 with the bifurcated part 125D nipping the first pivot shaft 123 so that the retractable member 125 may be attached to the first lateral guide 45A through the first pivot shaft 123. In other words, the housing 121 containing the first pivot shaft 123 may be integrally formed with the first lateral guide 45A in, for example, resin.

While the lifting device 95 is inactive and the lifting plate 43 lies horizontally, the rear-end portion 125R in the retractable member 125 is in a condition, where the second projection 125B contacts a lower surface of the rear-end portion 30R of the second placement unit 30. In this condition, the retractable member 125 is restricted from pivoting upward by the rear-end portion 30R of the second placement unit 30 and aligns with the front-rear direction. A position of the retractable member 125 in the first lateral guide 45A in this condition will be referred to as a first position. When the retractable member 125 is in the first position, an upper part of the retractable member 125 including the first projection 125A and the second projection 125B is located in an upper position with respect to the inclined edge 13A (see FIG. 4). The upper part of the retractable member 125 which is higher than the inclined edge 113A may restrict the sheets placed on the lifting plate 43 from moving in the widthwise direction.

Meanwhile, the spring 127 may be a torsion coil spring, which may be a piece of wire winded in a coil. One end of the spring 127 is held by the spring anchor 129, which is fixed to the lifting plate 43. The other end of the spring 127 is attached a central area in the front-rear direction of the retractable member 125 on a lower surface. When the retractable member 125 is pivoted to be closer to the lifting plate 43, the spring 127 is pressed by the retractable member 125 and may resiliently deform and produce a reaction force.

Figure 5:
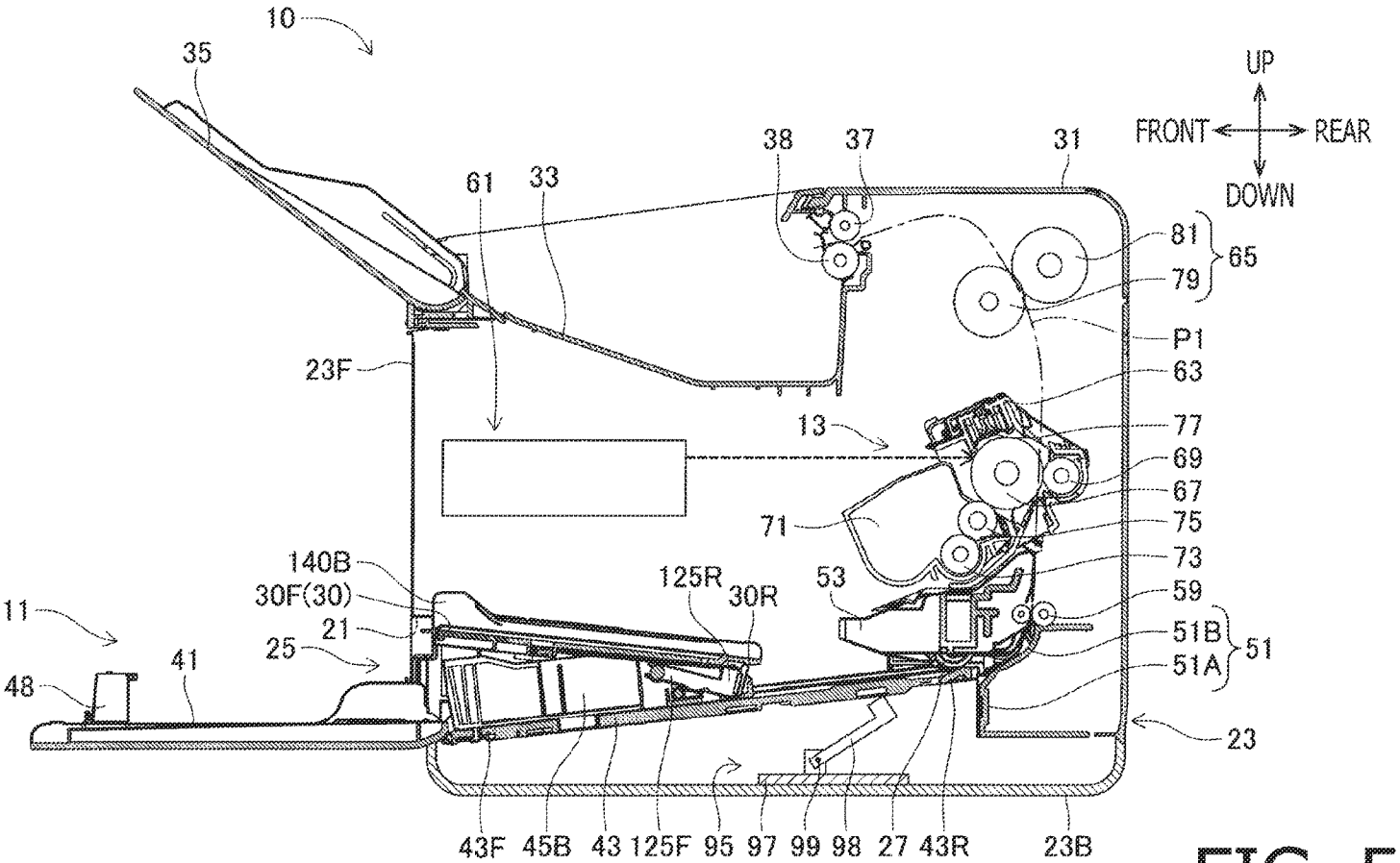
FIG. 5 is a cross-sectional leftward view of the laser printer, at the line B-B shown in FIG. 1, according to the first embodiment of the present disclosure, with the lifting plate uplifted to an uplifted position.

When the lifting device 95 is activated, and the lifting plate 43 is uplifted, the retractable member 125 may pivot to be closer to the lifting plate 43 by an effect of a reaction force from the second placement unit 30. As shown in FIG. 5, the retractable member 125 may be placed in an inclined condition with the rear-end portion 125R being lower than the front end portion 125F. Meanwhile, the second projection 125B (see FIG. 4) may contact the lower surface of the second placement unit 30. Further, a lower edge of the rear-end portion 125R may contact the upper surface of the lifting plate 43. A position of retractable member 125 in this inclined condition will be referred to as a second position. Thus, the first lateral guides 45A, 45B with the retractable members 125 in the first position may restrain the sheets on the first placement unit 25 from being displaced and may move vertically while the retractable members 125 in the second position may yield vertically to absorb collision with the second placement unit 30. In this configuration, when the sheet is placed on the lifting plate 43 being in the uplifted position, the sheet may contact the feed roller 27, but when no sheet is placed on the lifting plate 43 being in the uplifted position, the rear-end part 43R of the lifting plate 43 may contact the feed roller 27.

After completion of the printing operation, the lifting plate 43 may be lowered. The spring 127 may move the retractable member 125 to pivot upward by the resiliency thereof. The retractable member 125, with the second protrusion 125B contacting the lower surface of the rear-end portion 30R of the second placement unit 30, pivots upward about the first pivot shaft 123. When the first lateral guides 45A, 45B are placed in the first position (see FIG. 3), the retractable members 125 recover to the initial position aligning along the front-rear direction.

According to the first embodiment described herein, the print 10 may be advantageous in the following aspects. That is, the first lateral guides 45A, 45B each includes the retractable device 115, which is disposed on the outer side of the wall 13 on the rearward end. As the lifting plate 43 rises upward, the retractable member 125 in the retractable device 115 may contact the rear-end portion 30R of the second placement unit 30 and may be moved by the reaction force from the rear-end portion 30R to pivot from the first position to the second position. Thus, with the retractable members 125 being pivoted, collision of the first lateral guides 45A, 45B with the rear-end portion 30R of the second placement unit 30 may be absorbed by the retractable members 125. In other words, the first lateral guides 45A, 45B may be restrained from interfered with by the rear-end portion 30R as the lifting plate 43 moves upward.

In this regard, in order to merely reduce the collision between the lifting plate 43 and the second placement unit 30, for example, the first lateral guides 45A, 45B may be lowered to a position, in which the first lateral guides 45A, 45B should not interfere with the second placement unit 30. In this regard, however, in order to vertically separate the second placement unit 30 and the lifting plate 43 from each other, a volume of the printer 10 may be increased, at least in the height thereof. For another example, the first lateral guides 45A, 45B may be downsized. However, the downsized first lateral guides 45A, 45B may not provide sufficient height or may not sufficiently restrict the sheets from moving, and the sheets may be displaced on the lifting plate 43.

On the contrary, the first lateral guides 45A, 45B with the retractable devices 115 may be arranged vertically closer to the second placement unit 30 while the height and the length in the front-rear direction of the first lateral guides 45A, 45B may be achieved. Therefore, while the printer 10 may be downsized, displacement of the sheets on the lifting plate 43 may be effectively prevented.

As shown in FIG. 6, when the retractable member 125 is in the first position, the lower end of the rear-end portion 125R is vertically spaced apart from the upper surface of the lifting plate 43 for a distance L1. In the meantime, when the retractable member 125 is in the second position, as shown in FIG. 5, the lower end of the rear-end portion 125R is in the position to contact the lifting plate 43. Therefore, a movable amount in the vertical direction for the lower end of the rear-end portion 125R between the first position and the second position may be equal to the distance L1. In other words, the distance L1 between the lower end of the rear-end portion 125R of the retractable member 125 in the first position and the lifting plate 43 may be greater than or equal to the movable amount for the lower end of the retractable member 125 to move between the first position and the second position. According to this configuration, the rear-end portion 125R should not move to be lower than the upper surface of the lifting plate 43. Therefore, no boring or deforming works to the lifting plate 43 to reduce the interference between the rear-end portion 125R and the second placement unit 30 may be necessary, and rigidity of the lifting plate 43 may be maintained.

Further, the first projection 125 and the second projection 125B protruding upward are formed on the rear-end portion 125R. Without the first projection 125A and the second projection 125B, for example, as indicated by dash-and-dots hypothetical lines VL1 in FIG. 6, the retractable member 125 might be formed to have a same height throughout the length thereof along the front-rear direction at the height of the second projection 125B. When this hypothetical retractable member 125 is moved to pivot downward, a portion in the hypothetical retractable member 125 closer than the second projection 125B to the pivot axis might collide with the second placement unit 30.

For another example, the retractable member 125 without the first projection 125 and the second projection 125B might be arranged to be vertically separated farther apart from the second placement unit 30; however, the separation might increase the volume of the printer 10.

For another example, as indicated by a dash-and-dots hypothetical line VL2 in FIG. 6, the retractable member 125 might be formed to have a same height throughout the length thereof along the front-rear direction at a height of the frontend portion 125F. In this hypothetical shape, the height of the rear-end portion 125R may be reduced. Therefore, when a large amount of sheets are stacked on the lifting plate 43, a height of the sheet stack might be large, and an upper portion of the sheet stack might not sufficiently be restricted from moving by the height-reduced rear end portions 125R. Thus, with the retractable member 125 having the first projection 125A and the second projection 125B, the printer 10 may be downsized to be smaller, compared to a printer having the retractable member indicated by the hypothetical line VL1, and displacement of the sheets may be restrained more effectively than a printer having the retractable member indicated by the hypothetical line VL2.

Second Embodiment

Next, the printer 160 according to the second embodiment of the present disclosure will be described below. The printer 160 may be different from the printer 10 in the previous embodiment in that a lifting plate 161 is formed to have an insertion groove 169, in which a retractable member 167 may be inserted. In the following description, structures, parts, or items that are identical to those described in the previous embodiment may be referred to by a same reference sign, and redundant explanation of those may be omitted.

Figure 7:
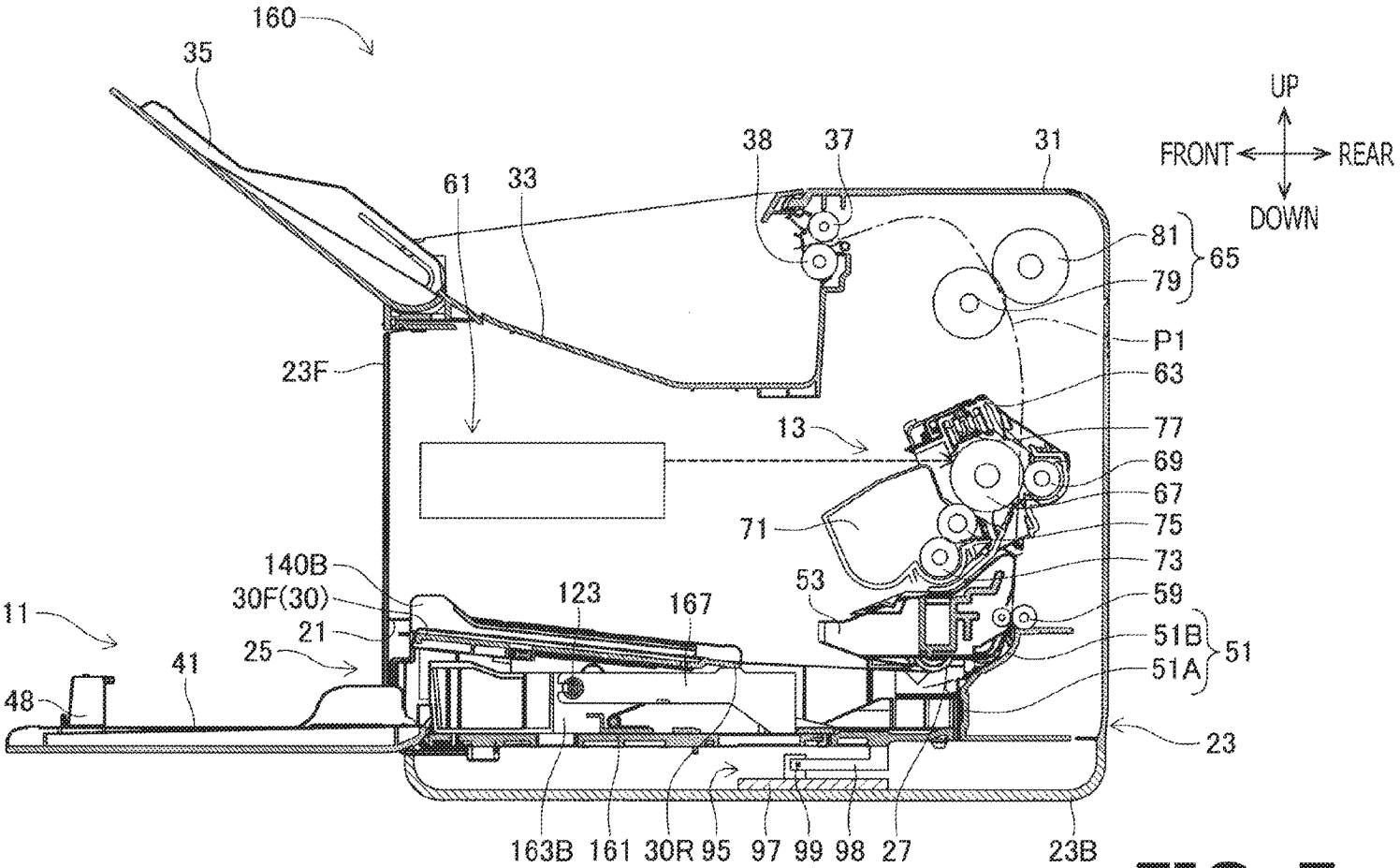
FIG. 7 is a cross-sectional rightward view of the laser printer according to a second embodiment of the present disclosure, with the lifting plate lowered to the separated position.
Figure 8:
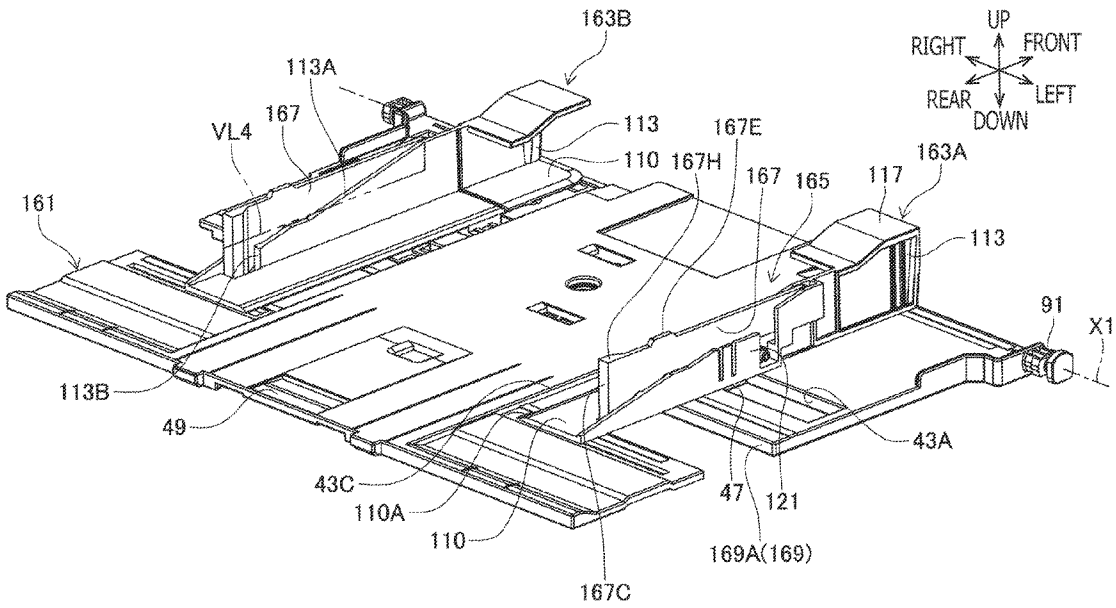
FIG. 8 is a perspective view of the lifting plate, in a view from an upper-rearward position, according to the second embodiment of the present disclosure.
Figure 9:
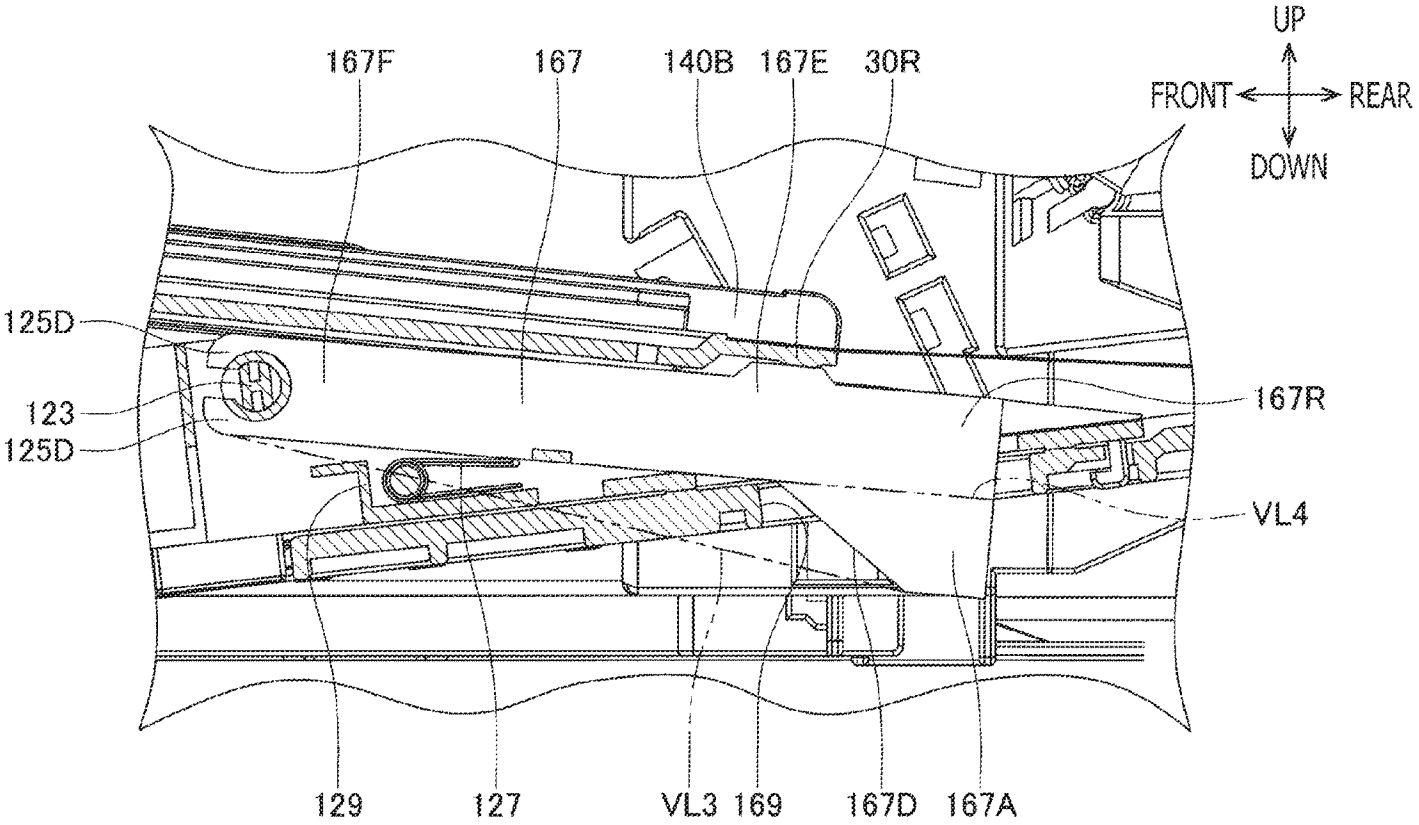
FIG. 9 is an enlarged view of the retractable member on the lifting plate in the second position according to the second embodiment of the present disclosure.

As shown in FIGS. 7-9, the lifting plate 161 in the second embodiment includes first lateral guides 163A, 163B. The first lateral guide 163A on the left and the first lateral guide 163B on the right are in a line-symmetric structure with respect to a hypothetical line, which extends through a midpoint between the first lateral guides 163A, 163B in parallel with the front-rear direction. Therefore, in the following description, while the first lateral guide 163A on the left may be described in detail, description of the first lateral guide 163B on the right may be omitted.

A retractable device 165 in the first lateral guide 163A is disposed on an outer side, or a leftward side, of the wall 113. The retractable device 165 is arranged to range from a frontward position with respect to a central position of the wall 113 in the front-rear direction to a position of the rear end of the wall 113. Therefore, a length of the retractable device 165 in the front-rear direction is greater than the length of the retractable device 115 in the previous embodiment in the front-rear direction.

In the housing 121 of the retractable device 165, disposed is a first pivot shaft 123, which extends in parallel with the widthwise direction. A retractable member 167 in the retractable device 165 includes a plate or a thin bar elongated in the front-rear direction. On a rear-end portion 167R of the retractable member 167, formed is a downward projection 167A, which projects downward. A rearward face 167C of the rear-end portion 167R and the downward projection 167A spreads in the widthwise and vertical directions. On a frontward end of the downward projection 167A, formed is an inclined edge 167D (see FIG. 9), which inclines to be lower on the rear side and higher on the front side.

A lower face of the downward projection 167A spreads in the front-rear and widthwise directions. Therefore, the downward projection 167A may be in a trapezoidal shape, in which a dimension in the front-rear direction is reduced as the downward projection 167A extends downward, in a view along the widthwise direction. Further, the downward projection 167A is formed to have a convex part 167H, which projects inward, e.g., rightward, in the widthwise direction. The convex part 167H projects inward to a position, in which the convex portion 167H faces with the rearward surface 113B of the wall 113 along the front-rear direction.

Further, on an upper edge of the retractable member 167, formed is an upward projection 167E, projects upward. The upper projection 167E is formed in a position, in which the upward projection 167E aligns with a front end of the inclined edge 167D formed on the lower end of the retractable member 167 in the vertical direction (see FIG. 9). While the lifting device 95 is inactive and the lifting plate 161 lies horizontally in the separated position, in the retractable member 167 being in the first position, the rear-end portion 167R is in a condition, where the upward projection 167E contacts a lower surface of the rear-end portion 30R and is restricted from being moved upward.

On a frontend portion 167F of the retractable member 167, formed is the bifurcated part 125D. The retractable member 167 is arranged to be pivotable in the vertical direction about the first pivot shaft 123, with the first pivot shaft 123 interposed between the two segments in the bifurcated part 125D. In the meantime, the lifting plate 161 has the insertion groove 169, which is formed in a shape, a size, and a position corresponding to those of the downward projection 167A. The insertion groove 169 is formed through the lifting plate 161 vertically. The insertion groove 169 forms an opening 169A at a leftward end thereof, therefore, the insertion groove 169 is formed to dent inward, e.g., rightward, from the leftward end of the lifting plate 161, in a downward view from above along the vertical direction. The insertion groove 169 is formed along the widthwise direction at a constant breadth in the front-rear direction. In the retractable member 167 in the first position, the lower face of the retractable member 167 is in an upper position with respect to the insertion groove 169, without being inserted in the insertion groove 169.

When the retractable member 167 is moved to pivot to the second position, the retractable member 167 is inserted in the insertion groove 169 (see FIG. 9). Therefore, the insertion groove 169 is formed in a range corresponding to a widthwise movable range of the first lateral guide 163A, which may slide in the widthwise direction. In particular, a rightward end of the insertion groove 169 is in a lower position with respect to the downward projection 167A in the first lateral guide 163*a*, when the first lateral guide 163A is in an innermost position corresponding to the second width W2 (see FIG. 1).

Figure 10:
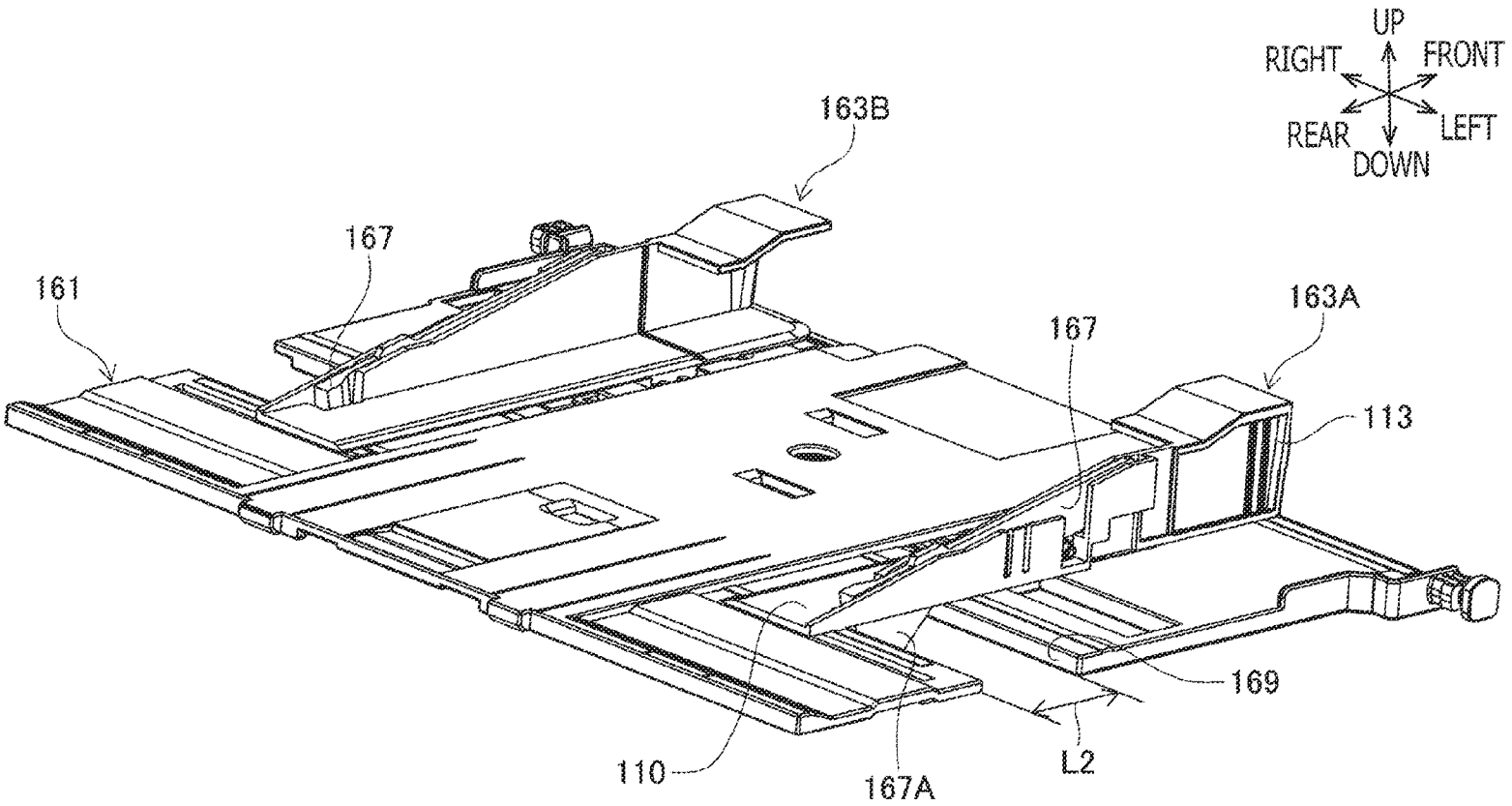
FIG. 10 is a perspective view of the lifting plate, in a view from an upper-rearward position, with the retractable member in the second position, according to the second embodiment of the present disclosure.

When the lifting device 95 is activated, and the lifting plate 161 is uplifted, the retractable member 167 may pivot to the second position to be closer the lifting plate 161 due to the reaction force from the second placement unit 30. As shown in FIGS. 9 and 10, the retractable member 167 in the second position may be placed in an inclined condition to be lower on the rear side and higher on the front side. The downward projection 167A is inserted in the insertion groove 169 in the lifting plate 161, and a lower part of the downward projection 167A, is in a lower position than the lifting plate 161. With this configuration, a movable amount for the retractable member 167 to yield to absorb the collision with the second placement unit 30 may be enlarged. Therefore, the first lateral guide 163A may be arranged in a position, in which the retractable member 167 may be required to move for a larger amount in order to avoid the collision with the second placement unit 30. For example, the first lateral guide 163A may be extended to be longer in the front-rear direction to a position on an upstream side of the sheet-conveying direction, e.g., rearward, so that the sheets on the lifting plate 161 may be held in the longer first lateral guides 163A, 163B more securely, and the displacement of the sheets on the lifting plate 161 may be restrained more effectively. When the lifting plate 161 is lowered, the retractable member 167 may move to pivot to be closer to the second placement unit 30 due to the resiliency of the spring 127, which is disposed in the lower position, and recover to the first position (see FIG. 7).

According to the second embodiment, the retractable member 167 is formed to have the downward projection 167A in the rear-end portion 167R. Without the downward projection 167A, for example, as indicated by a dash-and dots hypothetical line VL3 in FIG. 9, the retractable member 167 might be formed to have a shape, of which lower edge is lowered continuously rearward. When the retractable member 167 is moved to pivot downward, a portion in the retractable member 167 closer than the downward projection 167A to the pivot axis might collide with a front edge of the insertion groove 169. Therefore, for example, a breadth L2 (see FIG. 10) of the insertion groove 169 along the front-rear direction might need to be enlarged to avoid the collision; however, with the enlarged hypothetical insertion groove 169, the rigidity of the lifting plate 161 might be lowered. On the other hand, for another example, in order to avoid the collision, the retractable member 167 might be arranged to be vertically farther separated apart from the lifting plate 161; however, the separation might increase the volume of the printer 160.

For another example, as indicated by a dash-and-dots hypothetical line VL4 in FIGS. 7 and 9, the retractable member 167 may be formed to have a same height throughout the length thereof along the front-rear direction at a height of the frontend portion 167F. In this hypothetical shape, the height of the rear-end portion 167R might be reduced. Therefore, clearance might be formed at upper and lower positions with respect to areas between the rear-end portion 167A and the inclined edge 113A (see FIG. 8) of the wall 113 and between the rear-end portion 167R and the base 110. In this regard, the sheets on the lifting plate 167 might enter the clearance and may be displaced.

On the contrary, with the retractable member 125 having the downward projection 167A, the lifting plate 161 may be maintained to be more rigid, and the printer 160 may be downsized, compared to the hypothetical retractable member having the shape indicated by the hypothetical line VL3. Further, displacement of the sheets may be restrained more effectively than the hypothetical retractable member indicated by the hypothetical line VL4.

Although examples of carrying out the invention have been described, those skilled in the art will appreciate that there are numerous variations and permutations of the sheet conveyer and the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

Figure 11:
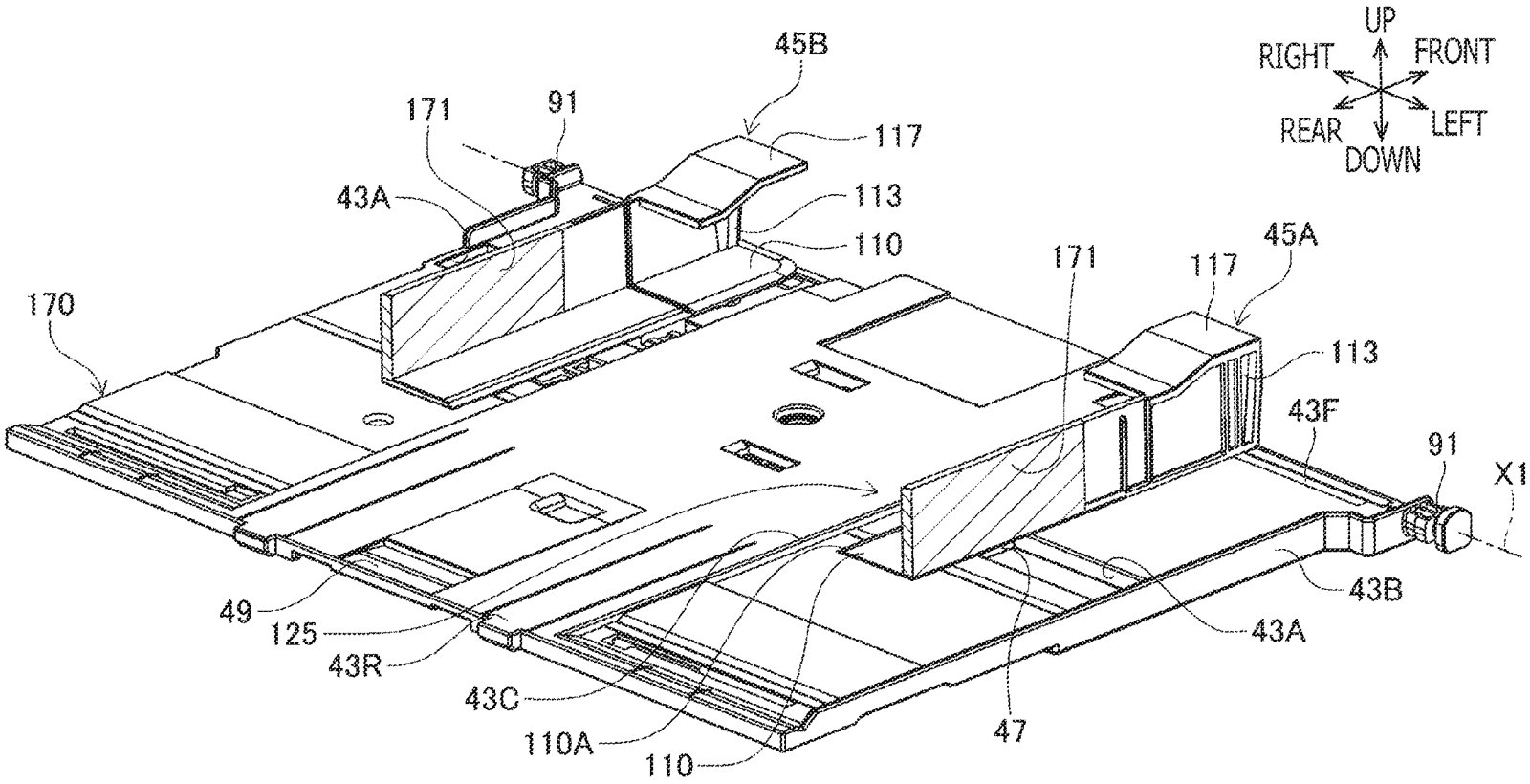
FIG. 11 is a perspective view of the lifting plate, from an upper-rearward position, with the retractable member according to a third embodiment of the present disclosure.

For example, the retractable members 125, 167 may not necessarily be pivotable members that are moved to pivot by the reaction force from the rear-end portion 30R. The retractable members 125, 167 may be replaced with, for example, a retractable member 171 (see FIG. 11), which may be resiliently deformed by the reaction force from the contacting item, e.g., the second placement unit 30. The retractable member 171 in FIG. 11 may be arranged in a rearward position with respect to the wall 113 in the first lateral guides 45A, 45B on a lifting plate 170. The retractable member 171 may be formed of a resiliently deformable material and may include, for example, a piece of urethane sponge. When the retractable member 171 is in the first position as shown in FIG. 11, an upper-rearward portion in the retractable member 171 may contact the rear-end portion 30R (see FIG. 2) of the second placement unit 30. As the lifting plate 170 rises, the retractable member 171 may be deformed by the reaction force from the second placement unit 30. Thus, the retractable member 171 may contract downward or bend sideward to avoid interference by the second placement unit 30.

For another example, the retractable members 125, 167 may not necessarily be in the first position, in which the retractable members 125, 167 contact the rear-end portion 30R of the second placement unit 30, when the lifting plates 43, 161 lies horizontally. The retractable members 125, 167 may be vertically spaced apart from the rear-end portion 30R when the lifting plates 43, 161 lie horizontally. In this arrangement, the retractable members 125, 167 may contact the rear-end portion 30R at one point while the lifting plate 43, 161 is being uplifted and may start moving with respect to the lifting plate 43, 161 thereafter when the lifting plates 43, 161 are lifted further upward.

For another example, with regard to the first embodiment, the lower end of the rear-end portion 125R of the retractable member 125 in the retractable device 115 when in the second position may not necessarily contact the lifting plate 43, but the retractable member 125 in the retractable device 115 in the second position may stop pivoting at a position separated upward from the lifting plate 43 for a predetermined distance.

For another example, the retractable member 125 in the first embodiment may not necessarily have the first projection 125A or the second projection 125B. For another example, the retractable member 125 may solely have one of the first projection 125A and the second projection 125B.

For another example, the retractable member 125 in the first embodiment may not necessarily be arranged to nip the first pivot shaft 123 at the bifurcated part 125D to be pivotable about the first pivot shaft 123. The retractable member 125 may be formed to have an opening, in which the first pivot shaft 123 may be inserted, in the front end portion 125F.

For another example, with regard to the second embodiment, the insertion groove 169 may not necessarily be formed through the lifting plate 169 but may be formed in a shape of a gutter with a bottom, in which the downward projection 167A may be inserted. For another example, the opening 169A may not necessarily be formed, but the insertion groove 169 may be a hole closed at the widthwise end of the lifting plate 161.

For another example, the insertion groove 169 may not necessarily be formed in the movable range of the first lateral guides 163A, 163B but may be formed in a range, in which the retractable member 167 may otherwise collide with the rear-end portion 30R of the second placement unit 30.

For another example, the retractable member 167 in the second embodiment may not necessarily have the downward projection 167A. For another example, the lifting plate 167 in the second embodiment may not necessarily have the insertion groove 169.

For another example, the item that the retractable members 125, 167 may contact may not necessarily be the second placement unit 30 but may be, for example, the holder frame 53, which supports the feed roller 27.

For another example, the lifting plates 43, 161 may not necessarily be pivotable about the shaft 91 but may be movable vertically in parallel with the bottom 23B of the body 23.

For another example, the sheet conveyer 11 may not necessarily be assembled in the printer 10, 160 for forming images but may be, for example, configured to be used as a sheet feeder alone, which may teed sheets to a predetermined position. For another example, the sheet conveyer 11 may be employed in an image processing apparatus, which may be equipped with one of scanning, copying, and facsimile-transmission functions, or in a multifunction peripheral device, which may be equipped with two or more of the printing, scanning, copying, and facsimile-transmission functions.

What is claimed is:

1. An image forming apparatus, comprising a sheet conveyer, the sheet conveyer comprising:

a sheet supporting plate;

a feed roller disposed in an upper position with respect to the sheet supporting plate, the feed roller comprising a rotation shaft extending in parallel with the sheet supporting plate;

a lifting device configured to move the sheet supporting plate between a separated position, in which the sheet supporting plate is separated from the feed roller, and a contacting position, in which the sheet supporting plate is lifted from the separated position to contact the feed roller;

a motor configured to drive the lifting device;

a sheet guide disposed on an upper surface of the sheet supporting plate to extend in a direction orthogonal to an axial direction of the rotation shaft of the feed roller, the sheet guide being movable in the axial direction on the upper surface of the sheet supporting plate; and a contact member disposed in an upper position with respect to the sheet guide; and an image forming unit configured to form an image on a sheet fed by the feed roller, wherein the sheet guide comprises:

a retractable member, the retractable member being movable between a first position, in which the retractable member is located when the sheet supporting plate is in the separated position, and a second position, in which the retractable member is located by an effect of a reaction force from the contact member produced by contact between the sheet supporting plate and the feed roller when the sheet supporting plate is in the contacting position to contact the feed roller;

a pivot shaft configured to support the retractable member pivotably at one end portion of the retractable member; and an urging member configured to urge the retractable member to pivot in a direction from the second position toward the first position, and wherein a distance between a lower end of the retractable member in the first position and the sheet supporting plate is greater than or equal to a movable amount for the lower end of the retractable member to move between the first position and the second position.

2. The sheet conveyer according to claim 1, wherein the retractable member comprises an upward projection formed to project upward on the other end portion opposite from the one end portion at which the retractable member is pivotably supported by the pivot shaft, in a direction orthogonal to the axial direction.

3. The sheet conveyer according to claim 1, further comprising:

a body comprising a conveyer path formed to convey a sheet fed by the feed roller therein, wherein the contact member includes a tray configured to be detachably attached to the body.

4. An image forming apparatus, comprising a sheet conveyer, the sheet conveyer comprising:

a sheet supporting plate having an insertion portion, the insertion portion being formed vertically through the sheet supporting plate;

a feed roller disposed in an upper position with respect to the sheet supporting plate, the feed roller comprising a rotation shaft extending in parallel with the sheet supporting plate;

a lifting device configured to move the sheet supporting plate between a separated position, in which the sheet supporting plate is separated from the feed roller, and a contacting position, in which the sheet supporting plate is lifted from the separated position to contact the feed roller;

a motor configured to drive the lifting device;

a sheet guide disposed on an upper surface of the sheet supporting plate to extend in a direction orthogonal to an axial direction of the rotation shaft of the feed roller, the sheet guide being movable in the axial direction on the upper surface of the sheet supporting plate; and a contact member disposed in an upper position with respect to the sheet guide; and an image forming unit configured to form an image on a sheet fed by the feed roller, wherein the sheet guide comprises:

a retractable member, the retractable member being movable between a first position, in which the retractable member is located when the sheet supporting plate is in the separated position, and a second position, in which the retractable member is located by an effect of a reaction force from the contact member produced by contact between the sheet supporting plate and the feed roller when the sheet supporting plate is in the contacting position to contact the feed roller, wherein at least a part of the retractable member is configured to be inserted into and to pass through the insertion portion of the sheet supporting plate when moving to the second position, and wherein the at least a part of the retractable member in the second position is located lower than the sheet supporting plate;

a pivot shaft configured to support the retractable member pivotably at one end portion of the retractable member; and an urging member configured to urge the retractable member to pivot in a direction from the second position toward the first position.

5. The sheet conveyer according to claim 4, wherein the at least a part of the retractable member comprises a downward projection formed to project downward on the other end portion opposite from the one end portion at which the retractable member is pivotably supported by the pivot shaft, in a direction orthogonal to the axial direction.

6. An image forming apparatus, comprising:

a sheet conveyer, the sheet conveyer comprising:

a sheet supporting plate;

a feed roller disposed in an upper position with respect to the sheet supporting plate, the feed roller comprising a rotation shaft extending in parallel with the sheet supporting plate;

a lifting device configured to move the sheet supporting plate between a separated position, in which the sheet supporting plate is separated from the feed roller, and a contacting position, in which the sheet supporting plate is lifted from the separated position to contact the feed roller;

a motor configured to drive the lifting device;

a sheet guide disposed on an upper surface of the sheet supporting plate to extend in a direction orthogonal to an axial direction of the rotation shaft of the feed roller, the sheet guide being movable in the axial direction on the upper surface of the sheet supporting plate; and a contact member including a tray, the contact member being disposed in an upper position with respect to the sheet guide, a body comprising a conveyer path formed to convey a sheet fed by the feed roller therein, wherein the tray of the contact member is configured to be detachably attached to the body; and an image forming unit configured to form an image on the sheet fed by the feed roller, wherein the sheet guide comprises a retractable member, the retractable member being movable between a first position, in which the retractable member is located when the sheet supporting plate is in the separated position, and a second position, in which the retractable member is located by an effect of a reaction force from the contact member produced by contact between the sheet supporting plate and the feed roller when the sheet supporting plate is in the contacting position to contact the feed roller.

* * * * *